US006752527B2

(12) United States Patent
Galletti

(10) Patent No.: US 6,752,527 B2
(45) Date of Patent: Jun. 22, 2004

(54) LIGHT INEXPENSIVE CROSS FOR MIXERS OF CONCRETE, MORTAR AND SIMILAR MATERIALS

(75) Inventor: Paolo Galletti, Perugia (IT)

(73) Assignee: Officine Meccaniche Galletti, O.M.G. S. R. L., Perugia (IT)

( * ) Notice: Subject to any disclaimer, the term of this patent is extended or adjusted under 35 U.S.C. 154(b) by 4 days.

(21) Appl. No.: 10/270,832

(22) Filed: Oct. 11, 2002

(65) Prior Publication Data

US 2003/0072209 A1 Apr. 17, 2003

(30) Foreign Application Priority Data

Oct. 15, 2001 (IT) ..... MC20010043 U

(51) Int. Cl.[7] ..... B28C 5/08
(52) U.S. Cl. ..... 366/66; 366/67
(58) Field of Search ..... 366/64, 65, 66, 366/67, 292, 297, 331

(56) References Cited

U.S. PATENT DOCUMENTS 2,677,533 A * 5/1954 McMurray ..... 366/285
3,020,029 A * 2/1962 Fejmert ..... 366/65
3,081,983 A * 3/1963 Thibodeaux ..... 366/65
3,160,399 A * 12/1964 Harrison ..... 366/65
3,160,400 A * 12/1964 Harrison ..... 366/65
3,168,296 A * 2/1965 Cowley ..... 366/65
3,214,145 A * 10/1965 Brown, Jr. ..... 366/94
3,215,412 A * 11/1965 Kindler ..... 366/65
3,456,926 A * 7/1969 Hummelshoj ..... 366/65
3,690,622 A * 9/1972 Brunner et al. ..... 366/52
4,148,588 A * 4/1979 Kanda et al. ..... 366/56
4,165,185 A * 8/1979 Fejmert ..... 366/65
4,191,478 A * 3/1980 Zupancic et al. ..... 366/67
4,343,554 A * 8/1982 Tawara ..... 366/65
4,403,863 A * 9/1983 Fukushima et al. ..... 366/67
4,453,831 A * 6/1984 Mahon ..... 366/65
4,506,984 A * 3/1985 Strehlow ..... 366/65
4,607,958 A * 8/1986 Ohshima et al. ..... 366/65
4,738,608 A * 4/1988 Heatlie ..... 366/64
4,741,483 A * 5/1988 Damm et al. ..... 366/296
5,393,139 A * 2/1995 Thorson et al. ..... 366/65
6,161,954 A * 12/2000 DeWall ..... 366/65
6,227,697 B1 * 5/2001 Stahl ..... 366/65

* cited by examiner

*Primary Examiner*—Tony G. Soohoo
(74) *Attorney, Agent, or Firm*—Armstrong, Kratz, Quintos, Manson & Brooks, LLP

(57) ABSTRACT

The present invention relates to a cross used in mixers for concrete, mortar and similar materials, characterised in that it has a very light, inexpensive metal structure obtained with oxygen lance cutting technique and basically composed of three spokes projecting at 120° from a central hub; it being provided that the end of each spoke is fixed to a mixing arm by means of a series of bolts with vertical axis in order to prevent the arm from rotating around its axis when moving through the ingredients to be mixed.

6 Claims, 3 Drawing Sheets

LIGHT INEXPENSIVE CROSS FOR MIXERS OF CONCRETE, MORTAR AND SIMILAR MATERIALS

The present patent application relates to a light inexpensive cross used in mixers for concrete, mortar and similar materials.

The invention has been devised to optimise a very popular technology used for the realisation of automatic mixers for concrete, mortar and other building materials.

Traditional mixers are composed of a large circular tank that contains the mix ingredients, in which multiple sets of three basically vertical rotary mixing arms operate, whose lower part is provided with blades used to continuously mix the mass contained in the tank until the different ingredients are completely blended.

In order to ensure the rotation of the aforementioned arms, a large gearmotor is placed vertically over the tank lid, on whose shaft a crown wheel is splinted to drag into rotation three rotary plates, with each plate associated to one set of three arms.

Each rotary plate, of basically triangular shape, has a quite strong metal structure obtained with casting and characterised in that each corner is provided with a sort of clamp used to block the upper end of the tubular mixing arm.

More precisely, on each corner the plate incorporates a semicircular sleeve (a jaw) in which the upper end of the mixing arm is engaged. The arm is then blocked by means of a second semicircular jaw capable of being tightened with the first fixed jaw with bolts with horizontal axis.

It appears evident that the fixing of the mixing arm to the traditional plate is quite complex. Moreover, this operation is complicated by the fact that it requires the presence of a special anti-rotation cover capable of preventing the mixing arm from accidentally rotating around its axis in the two fixing jaws because of the resistance encountered by the blade during mixing and caused by the presence of lumps in the mix or by the undesired interference with the tank bottom.

In practical terms, the operation needed to rigidly fix the mixing arm to the blade-holding plate is particularly complicated, in view of the fact that during the mixer operation it is often necessary to vary the position of the arms with respect to the tank bottom, by moving them slightly downwards to restore the very short distance between the lower border of the blades of the arms and the bottom of the wall, which is necessary to obtain good-quality mix.

In order to ensure good mixing, the blades that are located at the end of the three arms must graze the bottom of the mixing tank during rotation; this condition, however, is often impossible due to the wear of the blades or tank on the "circular paths" that are continuously followed by the three rotary blades on the bottom of the tank.

Wear appears quite suddenly when the hardest ingredients of the mix (for example gravel) get between the lower border of the blades and the bottom of the tank, thus creating significant interference.

As soon as wear creates an excessive space between the border of the blades and the bottom of the tank, the three blade-holding arms must be moved downwards slightly to restore the correct position with respect to the tank bottom.

As mentioned above, the adjustment of the blade position is extremely uncomfortable and complicated with the current technology, since it is necessary to remove the anti-rotation cover from the top of the arm to be adjusted and separate the two fixing jaws.

Once these operations have been carried out, the position of the arm can be adjusted downwards. Then, the fixing jaws must be coupled and the anti-rotation cover replaced.

Traditional mixers are also impaired by another significant disadvantage, which is basically related to the frequent damage of the most delicate and expensive parts, that is the crown wheel and the gearmotor that drags it into rotation.

When rotating near the tank bottom, the blade of the mixing arm can often interfere vigorously with particularly compact lumps of material or even with the bottom wall of the tank in the unload sector.

If we consider that the rotary blade is provided with certain inertia, it appears evident that such an impact may cause a violent impact on the blade that also affects the mixer parts joined to the blade, that is to say the rotary holding plate, the crown wheel that drags the plate into rotation and the gearmotor that actuates the crown wheel, respectively.

In the worst case the impact can easily cause the irreversible breakage of the gears of the crown wheel or gearmotor, thus requiring the replacement of these sophisticated parts.

The specific purpose of the invention is to realise a cross used to support the mixing arms and capable of being applied to the crown wheel of traditional mixers in replacement of the heavy die-cast triangular plates.

As illustrated below, the new cross of the invention is much lighter and cheaper that traditional rotary arm-holding plates.

This first objective has been achieved thanks to the fact that the cross does not have the traditional triangular shape and is not obtained with casting. On the contrary, the new cross has a star-like shape, with three spokes projecting at 120° from a central hub, and is obtained from a plate with oxygen lance cutting technique.

Oxygen lance cutting is undoubtedly easier and less expensive than casting and provides crosses with the same efficiency and resistance as traditional crosses.

The new cross of the invention provides rapid and easy fixing of mixing arms, which are also obtained with oxygen lance technique, while completely preventing the mixing arms from rotating around their axis even in the presence of strong interference encountered in the mass to be mixed.

This is because each mixing arm is no longer fixed by means of a "double jaw" clamp, but with bolts with vertical axis that allow for firmly fixing, with no possibility of rotation, the upper end of each arm against the lower side of the spoke of the cross of the present invention.

Equally important from the practical viewpoint is the fact that in the new cross of the invention the adjustment in height of each mixing arm can be realised directly on the blade and therefore disassembling, adjusting and reassembling the entire mixing arm.

Moreover, the cross of the invention has the intrinsic capability of maintaining the integrity of the crown wheel and gearmotor of the mixer, including in the presence of strong impacts suffered by the blade-holding arms that are joined to it during rotation inside the mixture.

Each arm has been intentionally designed as the "weakest" element of the entire mixer structure; this means that, in the case of a violent impact suffered by the blade, the mixing arm breaks immediately, thus dissipating all the energy of the violent counterblow derived from the impact.

The "sacrifice" of the mixing arm prevents the counterblow from discharging directly on the more sophisticated and expensive mechanical parts (crown wheel and gearmotor). This "sacrifice" does not have any significant negative consequence, since the cost of each arm obtained with oxygen lance cutting technique is quite low, and replacement is very rapid and simple, thanks to the blocking systems with bolts.

Still with the aim to make the cross structure more convenient and functional, an alternate embodiment has been devised, without leaving the scope of the present invention.

This version is characterised by the fact that it consists in a simple triangular bearing plate provided with a central hub to be coupled to the crown wheel shaft and three independent separate spokes, capable of being fixed to the triangular bearing plate by means of suitable bolts, it being provided that each spoke can support a blade-holding arm of the type illustrated above.

It appears evident that this version of the cross aims at avoiding the difficulties and damages caused by the possible breakage of one of the spokes. In the case of breakage of one of the spokes of the "monolithic" cross illustrated above, the entire cross must be disassembled and replaced according to a procedure that is quite complicated for typical final users of concrete mixers.

In the latter version of the cross according to the present invention, the possible breakage of one of the three independent spokes simply involves the disassembly of the broken spoke and its replacement with a new spoke. It appears evident that such an operation can be carried out even by inexpert users, not only because it simply requires the loosening and tightening of the bolts, but also because it is no longer necessary to remove the coupling of the cross hub with the crown wheel shaft and restore the correct coupling of the hub of the new cross with the same shaft.

For major clarity the description of invention continues with reference to the enclosed drawings, which are intended for purposes of illustration and not in a limiting sense, whereby:

Figure 1:
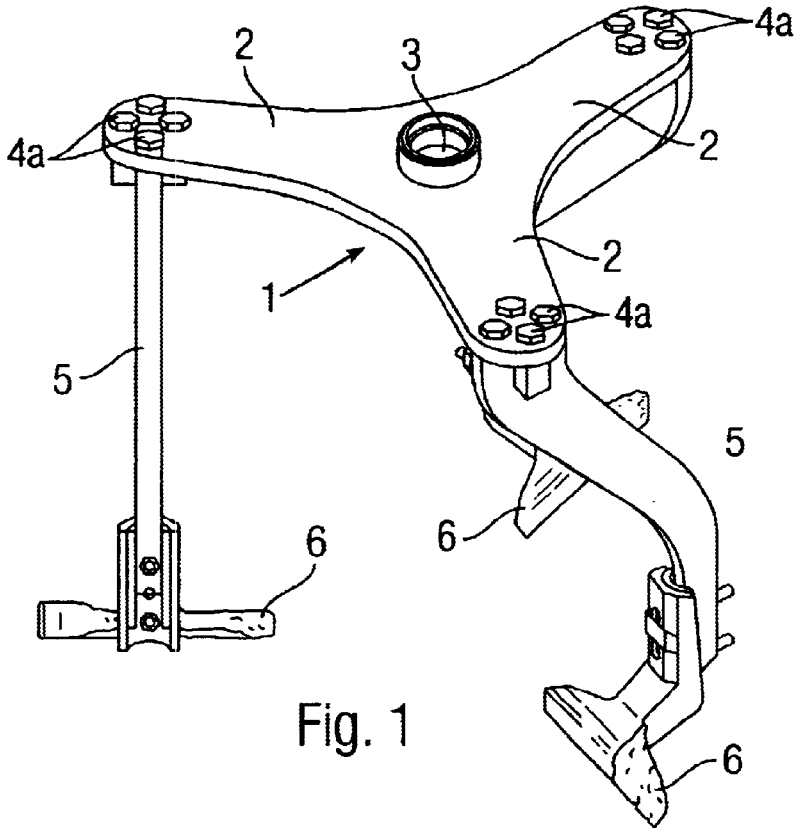
FIG. 1 is an axonometric view of the new cross of the invention.

With reference to Figures from 1 to 3, the cross of the invention (1) is obtained with oxygen lance cutting technique and provided with three (2) spokes projecting at 120° from a central hub (3) suitable for coupling to the shaft of the crown wheel of a mixer.

Four holes with vertical axis (4) are located at the end of each spoke (2) at 90° interval for the passage of four bolts with vertical axis (4*a*) designed to engage in threaded holes (5*b*) located on the "cross" head (5*a*) of a blade-holding arm (5).

It appears evident that once the bolts (4*a*) have been tightened, the cross head (5*a*) of each arm (5) is strictly and rigidly fixed to the lower side of the spoke (2) of the cross (1); this means that the replacement of one of the arms (5) of the cross of the invention (1) can be easily and rapidly carried out, by simply loosening the bolts (4*a*), replacing the broken arm with a new arm (5) and tightening the bolts (4*a*) again.

The cross head (5*a*) of the arm (5), as well as the location of the holes (5*b*) for the bolts (4*a*) at 90° interval, categorically prevent the arm (5) from rotating around its axis, after being fixed to the spoke (2) of the cross, even in the presence of very energetic interference encountered by the blade (6) during rotation in the mixing tank.

Figure 3:
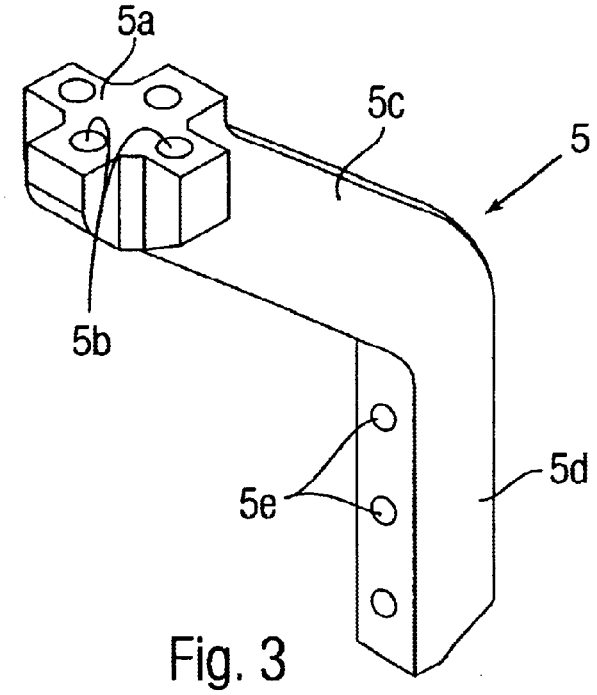
FIG. 3 is an axonometric view of one arm of the cross of the invention.
Figure 2:
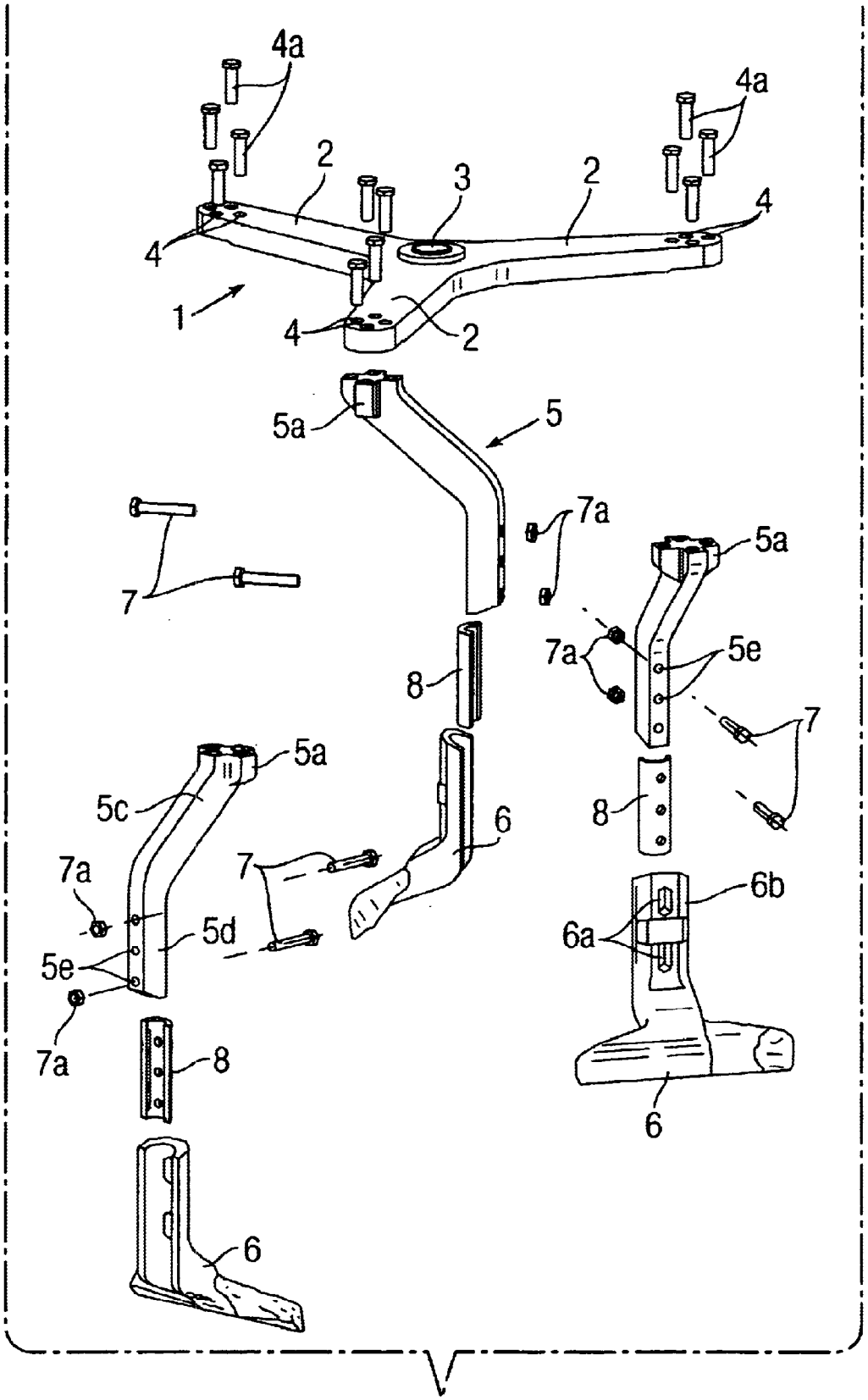
FIG. 2 is an exploded drawing of the same cross.

In the preferred constructive version shown in FIG. 3, the blade-holding arm (5) obtained with oxygen lance cutting technique has a special shaped profile, with a backward inclined section (5*c*) under the cross head (5*a*), which is coupled with a rectilinear section (5*d*) with basically vertical direction.

It must be noted that the structure of the arms (5) has been devised in such a way that it is the preferential breaking part in the entire structure of the mixer provided with the cross of the invention (1). In this way, the only consequence of the counterblow caused by the high impact suffered by the blade (6) of one of the arms (5) is the traumatic breakage of the corresponding arm (5), without damaging the most sophisticated and expensive parts (crown wheel and gearmotor) of the mixer.

It must be noted that the lower rectilinear section (5*d*) of each arm (5) is provided with through holes with horizontal axis (5*e*) located at different heights and used to fix and adjust the height of the mixing blade (6).

The possibility of adjusting the height of each blade (6) is ensured by the presence of slots (6*a*) on the vertical fixing tang (6*b*) with basically semi-cylindrical profile.

The slots (6*a*) house bolts (7) capable of being inserted in the holes (5*e*) located on the lower vertical section (5*c*) of the arm (5) and tightened on the opposite side by means of nuts (7*a*).

The presence of the slots (6*a*) permits the rapid and easy adjustment in height of the blade (6) with respect to the arm (5) by simply moving the blade downward; it being provided that the bolts (7) are loosened and then tightened before and after this operation, respectively.

Particularly important is the presence of an elastically deformable semi-cylindrical plastic insert (8) in intermediate position between the semi-cylindrical tang (6*b*) of the blade (6) and the lower section (5*c*) of the mixing arm (5).

The function of the deformable insert (8) is to permit the close adhesion of the tang (6*b*) of the blade (6) with the flat side of the arm (5), even in the presence of non-perfectly matching surfaces.

An additional advantage provided by the presence of the deformable insert (8) is the possibility of avoiding cracks on the fragile iron cast structure of the blade (6), when tightening the bolts (7), as it can possibly happen when morphologically incompatible surfaces come into direct contact only in a few points, on which the entire tightening force of the bolts (8) is discharged inevitably.

Figure 4:
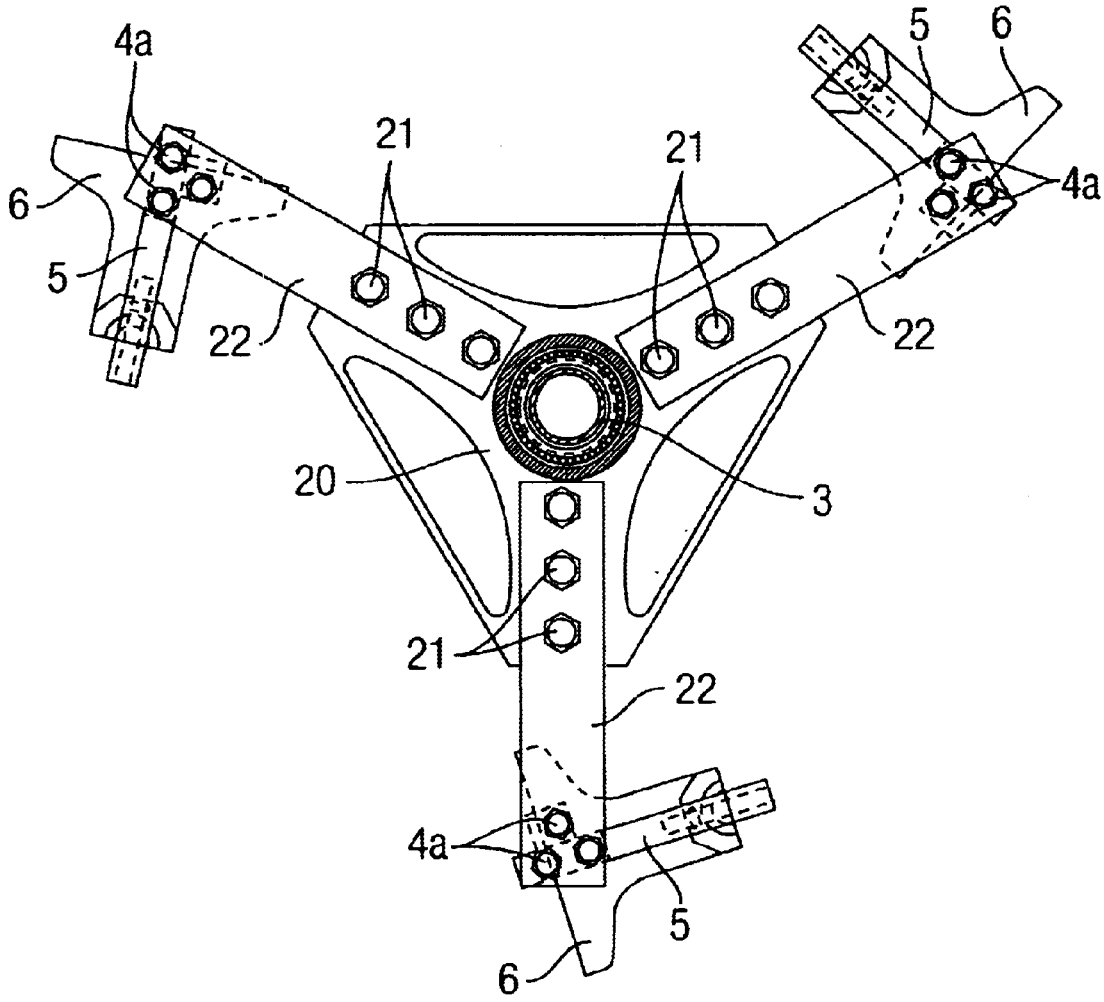
FIG. 4 is a top view of the alternate constructive version of the cross of the invention.

With reference to FIG. 4, the cross of the invention has also been designed in an alternate construction version provided with separable spokes.

In this version the cross consists in a triangular plate (20) that centrally supports the hub (3).

Three rectilinear spokes (22) at 120° are fixed on the triangular plate (20) with bolts (21) with vertical axis, it being provided that the three blade-holding arms (5) of the type illustrated above are normally fixed with traditional bolts (4*a*) with vertical axis on the projecting ends of the spokes (22).

What is claimed is:

1. A light inexpensive cross used in mixers for concrete, mortar and similar materials, characterised in that it features a metal structure obtained with oxygen lance cutting technique, composed of three spokes (2, 22) projecting at 120° from a central hub (3), with each spoke provided on the external end with four holes with vertical axis (4) spaced at 90° for the passage of four bolts with vertical axis (4*a*) designed to engage into threaded holes (5*b*) located on the "cross" head (5*a*) of a blade-holding arm (5) when the blade-holding arm (5) touches the lower side of the spoke (2, 22); it being provided that the rectilinear ending section (5*d*) has a series of through holes with horizontal axis (5*e*) that allow for fixing with bolts (7) and nuts (7*a*) the vertical tang (6*b*) of a mixing blade (6), which, in turn, is provided with suitable through slots (6*a*) that permit the adjustment in height with respect to the ending section (5*d*) of the bearing arm (5); it being provided that an elastically deformable plastic insert (8) is mounted in intermediate position between the tang (6*b*) of the blade (6) and the ending section (5*d*) of the bearing arm (5).

2. A light inexpensive cross used in concrete mixers according to claim 1, characterised in that it is provided with special blade-holding arms (5) obtained with oxygen lance cutting technique and provided with a shaped profile with backward inclined section (5*c*) under the top cross head (5*a*), which is connected with a rectilinear section (5*d*) with basically vertical direction.

3. A light inexpensive cross used in concrete mixers, according to claim 1, characterised in that it is provided with blade-holding arms (5) are designed in such a way that they are the preferential breaking part of the entire structure of the mixer provided with the cross (1) in the presence of violent impacts suffered by the mixing blades (6).

4. A light inexpensive cross used in concrete mixers according to claim 1, characterised in that the deformable insert (8) has a basically semi-cylindrical shape capable of matching with the same shape of the tang (6*b*) of the blade (6).

5. A light inexpensive cross used in concrete mixers according to claim 1, characterised in that the three spokes (2) are incorporated into the same monolithic structure that supports the central hub (3).

6. A light inexpensive cross used in concrete mixers according to claim 1, characterised in that it is provided with independent spokes (22) fixed with bolts with vertical axis (21) to the central bearing structure (20) that supports the central hub (3) of the cross.

* * * * *